US006505353B2

(12) United States Patent
Sung

(10) Patent No.: US 6,505,353 B2
(45) Date of Patent: Jan. 14, 2003

(54) PAD STRUCTURE OF SWIMMING GLASSES

(76) Inventor: Hsiu-Ying Sung, P.O. Box 26-757, Taipei (TW)

( * ) Notice: Subject to any disclaimer, the term of this patent is extended or adjusted under 35 U.S.C. 154(b) by 0 days.

(21) Appl. No.: 09/872,432

(22) Filed: May 30, 2001

(65) Prior Publication Data

US 2002/0178489 A1 Dec. 5, 2002

(51) Int. Cl.[7] ..... A61F 9/02
(52) U.S. Cl. ..... 2/428
(58) Field of Search ..... 2/428, 430, 431, 2/446; 351/43

(56) References Cited

U.S. PATENT DOCUMENTS 4,468,819 A * 9/1984 Ohno ..... 2/430
5,857,221 A * 1/1999 Geneve et al. ..... 2/428
6,119,277 A * 9/2000 Chiang ..... 2/428

* cited by examiner

*Primary Examiner*—John J. Calvert
*Assistant Examiner*—Katherine Moran
(74) *Attorney, Agent, or Firm*—Rosenberg, Klein & Lee

(57) ABSTRACT

The present invention proposes an improved pad structure of swimming glasses, wherein the pad thereof is integrally formed of soft material. The outer side of the pad forms a ring face, which can contact tightly with the skin of eye socket to achieve airtight effect. A plurality of enhancement structures for increasing the resiliency of the pad are alternately disposed between the inner and outer side faces of the pad, thereby effectively resisting the pressure of water and increasing the resiliency of the swimming glasses. Moreover, the position of the swimming glasses can be elevated to prevent the nose bridge from contacting with a hard joining ring and to enhance the comfort of wearing.

1 Claim, 7 Drawing Sheets

PAD STRUCTURE OF SWIMMING GLASSES

FIELD OF THE INVENTION

The present invention relates to an improved pad structure of swimming glasses and, more particularly, to a waterproof device worn when swimming to avoid discomfort of eyes.

BACKGROUND OF THE INVENTION

As shown in FIGS. 1 to 3, a pair of swimming glasses in the prior art comprise two lenses 50 made by extrusion of hard and transparent material. The adjacent sides of the two lenses 50 extend to form two lock rings 51, and the left and right sides thereof also extend to form two lock rings 51*a*, respectively. A joining ring 52 is disposed between the two lenses 50. The joining ring 52 can connect the two lock rings 51 so that the two lenses 50 can be joined together. A plurality of flanges 52*a* are disposed at inner sides of two ends of the joining ring 52. The flanges 52*a* can be locked with the lock rings 51 to adjust the distance between the two lenses 50. The two lock rings 51*a* at the left and right sides of the two lenses 50 are connected by a head band 53. The inner side of the lens 50 forms a ring face 50*a*. The ring face 50*a* at the inner side of the lens 50 joins a pad 54. A groove 54*a* is formed in the midst of the pad 54. The outer edge of the groove 54*a* also has a ring face 55.

Please also refer to FIGS. 1 to 3, when the swimming glasses are worn, the head band 53 of the swimming glasses is sleeved on the head and fixed, the two lenses 50 made by extrusion of hard and transparent material are then adjusted and fixed on the skins of eye sockets, and the ring faces 55 of the pads 54 contact tightly with the skins of eye sockets, thereby letting the swimming glasses achieve airtight effect.

However, when the swimming glasses are worn, it is necessary to pull the head band 53 to the head and fix it and let the ring faces 55 of the pads 54 contact tightly with the skins of eye sockets. For comfort of wearing, the pad 54 is made of soft material. Because the material of the groove 54*a* is also soft material, and the soft material near the eye socket is very thin, the groove 54*a* easily shrinks and the material easily deforms when overly used, hence losing the airtight effect.

Moreover, because of shrinkage and deformation of the groove 54*a*, the position of the swimming glasses will be too near the face so that the nose bridge of the user will contact with the hard joining ring 52 of the swimming glasses, resulting in discomfort or even abrasion of the skin of the nose bridge.

When the user swims, the water pressure will press the swimming glasses to shrink the grooves 54*a*, resulting in bad circulation of blood. Therefore, the swimming glasses cannot be worn for a long time. Moreover, when the swimming glasses are taken off, pressed marks will be generated on the face because of bad circulation of blood.

Therefore, the above pad structure of swimming glasses has inconvenience and drawbacks in practical wearing or use. The present invention aims to resolve the above problems in the prior art.

SUMMARY OF THE INVENTION

The primary object of the present invention is to provide an improved pad structure of swimming glasses capable of effectively increasing the resiliency of swimming glasses and enhancing the comfort of wearing.

The secondary object of the present invention is to provide an improved pad structure of swimming glasses so that pressed marks generated on the skins of eye sockets because of bad circulation of blood can be avoided.

Another object of the present invention is to provide an improved pad structure of swimming glasses, wherein a plurality of enhancement structures are added and alternately disposed between the inner and outer side faces of die pad to alleviate the position of the swimming glasses and to prevent the abrasion of the skin of the nose bridge because of the contact of the nose bridge with the hard joining ring of the swimming glasses.

The various objects and advantages of the present invention will be more readily understood from the following detailed description when read in conjunction with the appended drawing, in which:

DETAILED DESCRIPTION OF THE PREFERRED EMBODIMENTS

Figure 1:
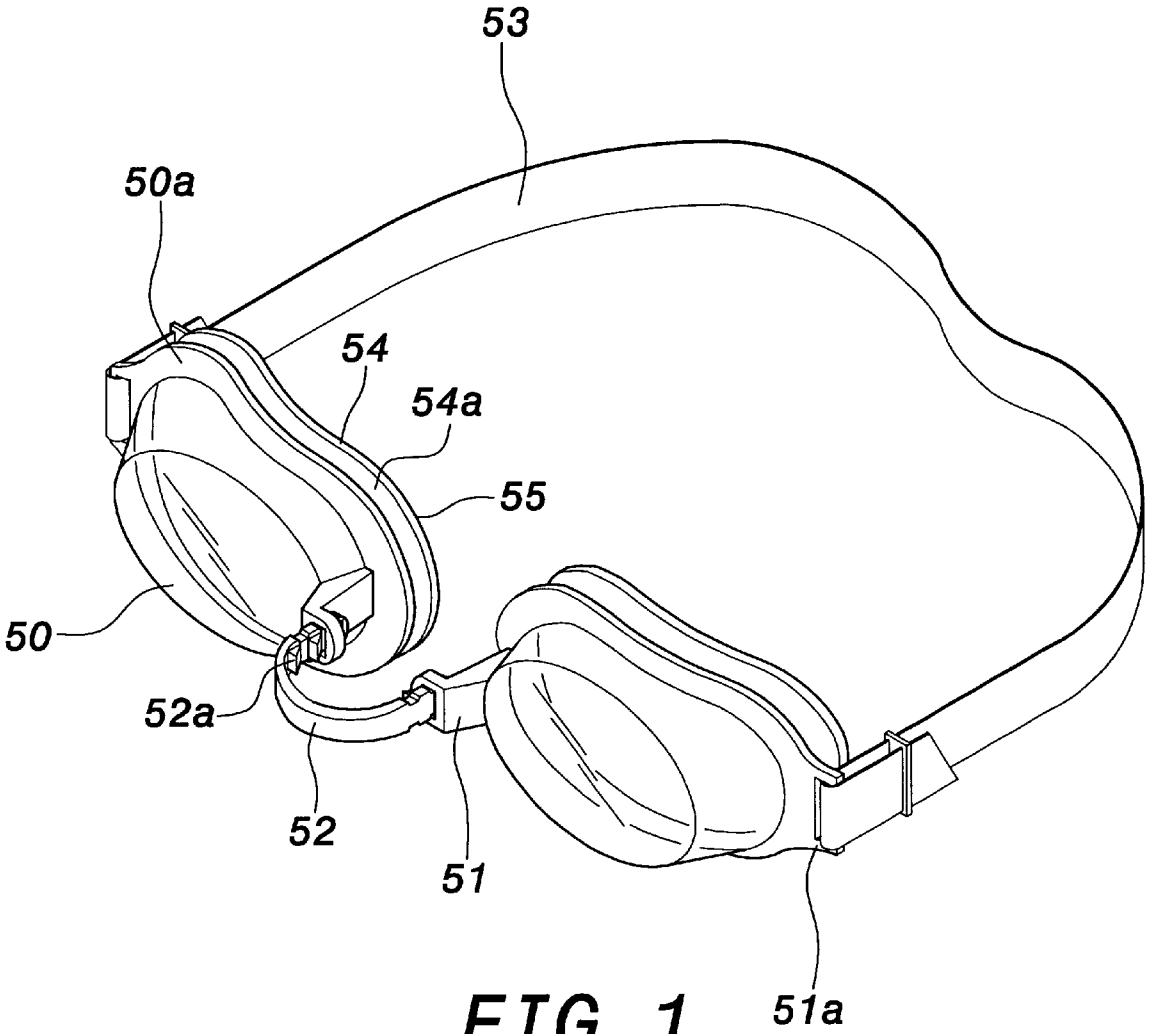
FIG. 1 PRIOR ART
FIG. 1 is a perspective view of a pair of swimming glasses in the prior art.
Figure 2:
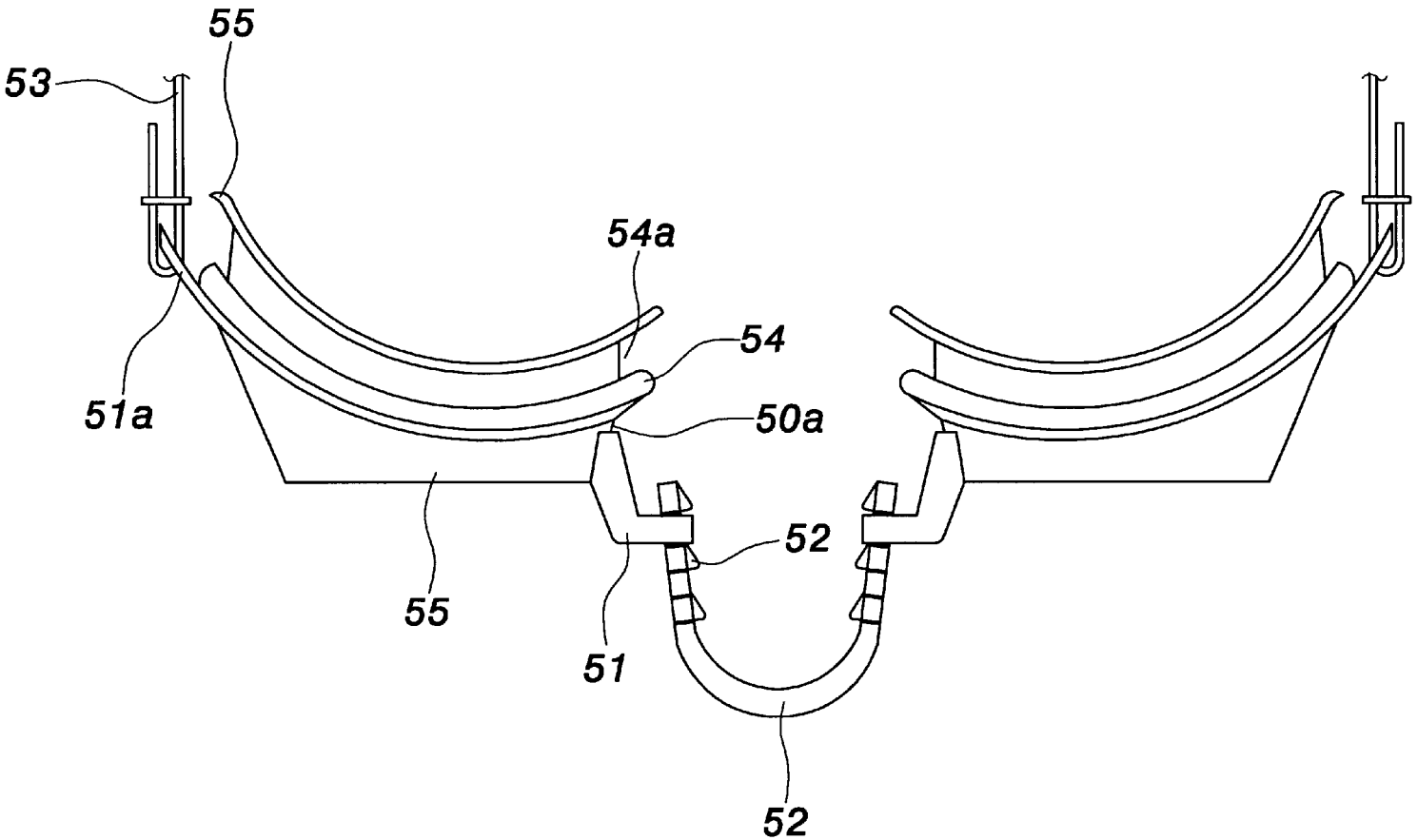
FIG. 2 PRIOR ART
FIG. 2 is a top view of a pair of swimming glasses in the prior art.
Figure 3:
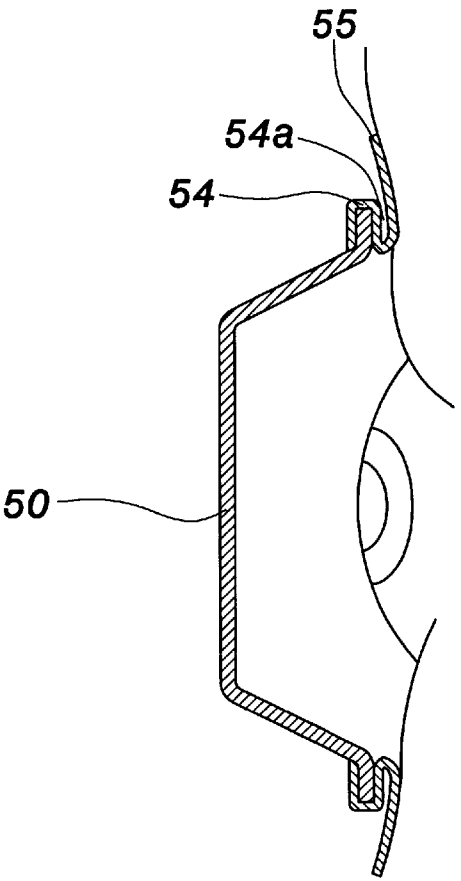
FIG. 3 PRIOR ART
FIG. 3 is a cross-sectional view showing the use state of a pair of swimming glasses in the prior art.
Figure 4:
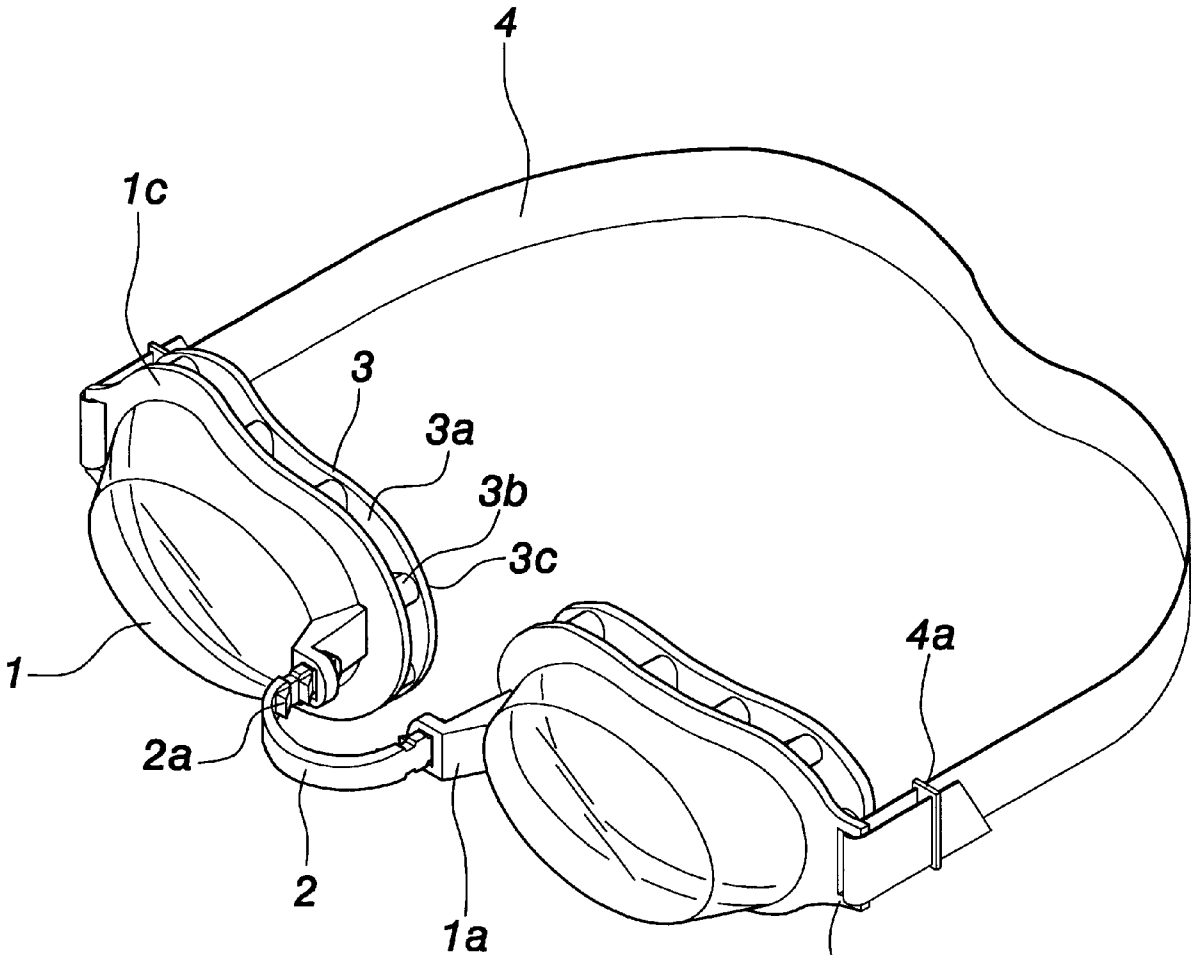
FIG. 4 is a perspective view of an improved pad structure of swimming glasses of the present invention.
Figure 5:
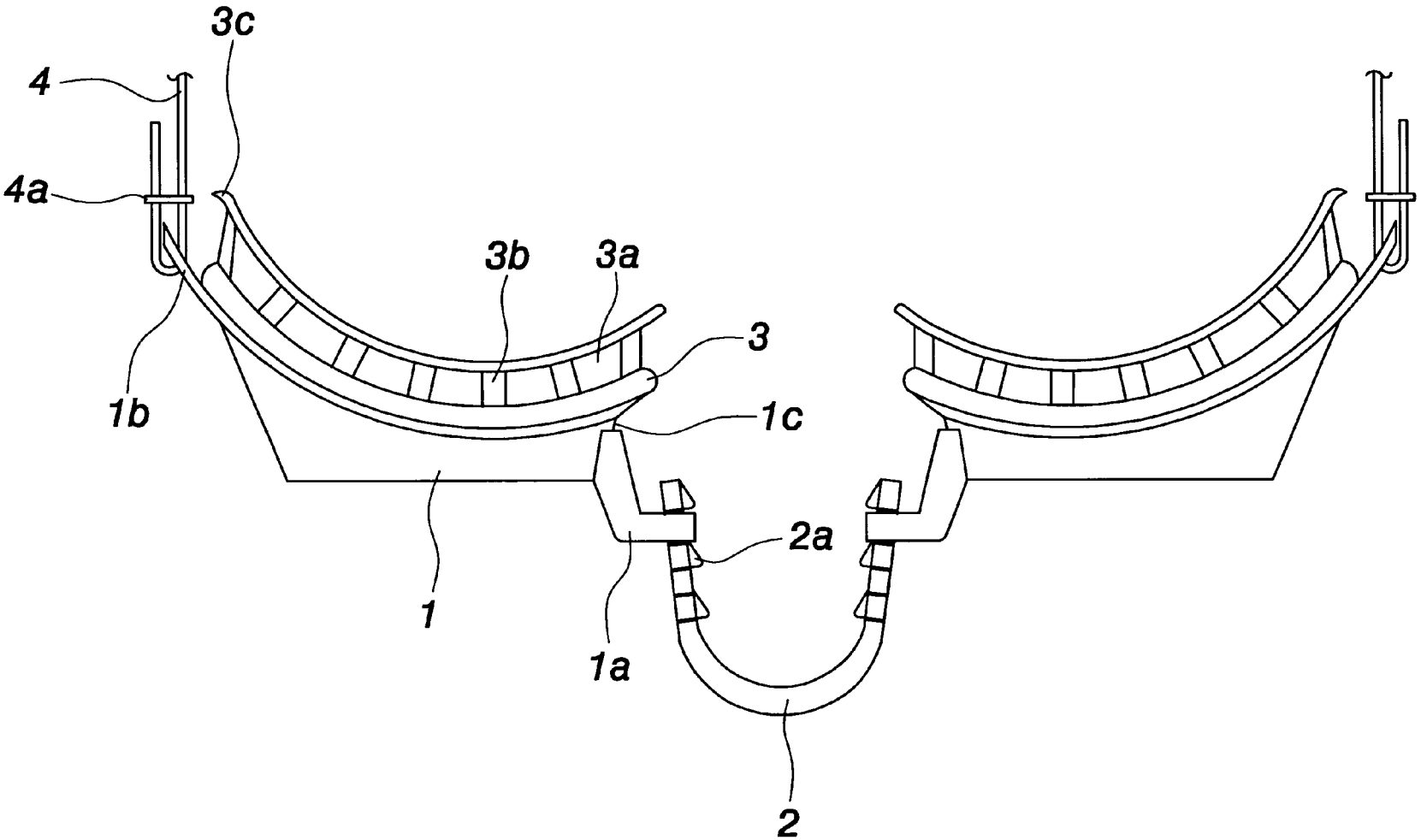
FIG. 5 is a top view of an improved pad structure of swimming glasses of the present invention.
Figure 6:
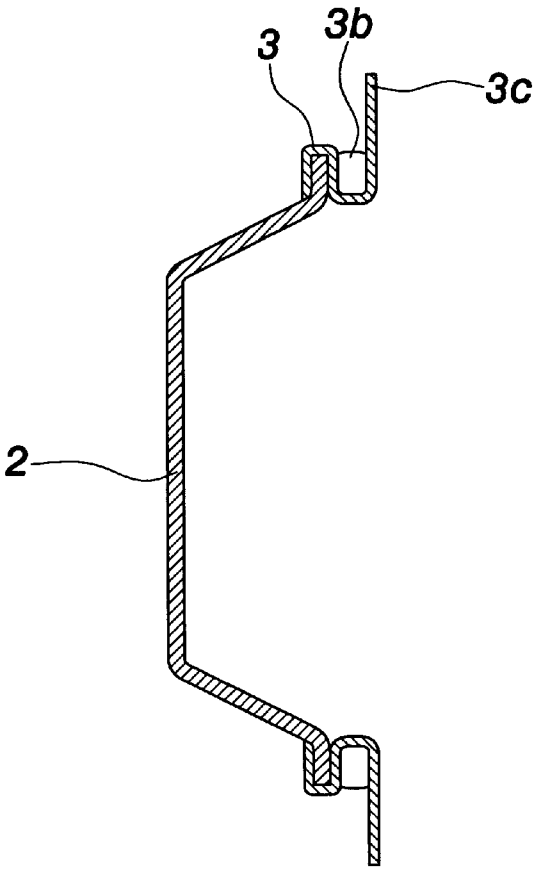
FIG. 6 is a cross-sectional view of an improved pad structure of swimming glasses of the present invention.
Figure 7:
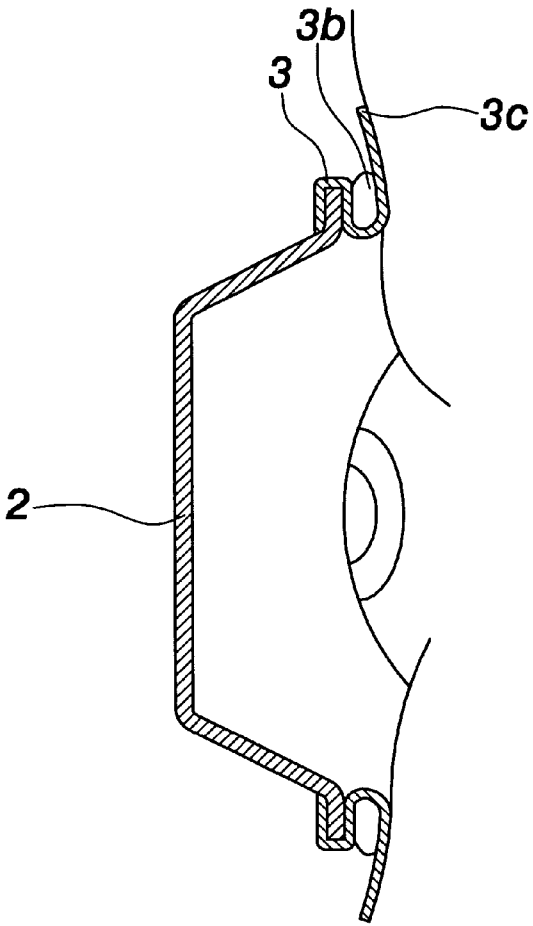
FIG. 7 is a cross-sectional view showing the use state of an improved pad structure of swimming glasses of the present invention.

As shown in FIGS. 4 to 7, an improved pad structure of swimming glasses of the present invention comprises two lenses 1 made by extrusion of hard and transparent material. The adjacent sides of the two lenses 1 extend to form two lock rings 1*a*, and the left and right sides thereof also extend to form two lock rings 1*b*, respectively. A joining ring 2 is disposed between the two lenses 1. The joining ring 2 can be inserted into the locking rings 1*a* so that the two lenses 1 can be joined together. A plurality of flanges 2*a* are disposed at inner sides of two ends of the joining ring 2. The flanges 2*a* can be locked with the lock rings 1*a* to adjust the distance between the two lenses 1. The two lock rings 1*b* at the left and right sides of the two lenses 1 are connected by a head band 4. Two ends of the head band 4 can be inserted into the lock rings 1*b* at the left and right sides of the lenses 1. Two distal ends of the head band 4 have two lock devices 4*a*, respectively. The lock devices 4*a* can prevent the head band 4 from detaching from the lock rings 1*b* at the left and right sides of the lenses 1. The lock devices 4*a* at the distal ends of the head band 4 can also be used to adjust the degree of tightness of the swimming glasses.

The outer side of the lens 1 forms a rising face 1*c*, which joins a pad 3 of soft material. A plurality of enhancement structures 3*b* are formed in the midst of a groove 3*a* in the pad 3. The enhancement structures 3*b* arc alternatively disposed in the groove 3*a* of the pad 3 to enhance the resilience of the swimming glasses and to elevate the position of the swimming glasses for preventing the nose bridge from contacting with the hard joining ring 2 of the swimming glasses. The outer edge of the groove 3*a* also has a ring face 3*c*, which is to be fixed on the skin of eye socket.

The ring face 3*c* is also made of soft-material to enhance comfort of wearing.

Please also refer to FIGS. 4 to 7. When the swimming glasses are worn, it is necessary to first sleeve the head band 4 of the swimming on the head and then adjust the two lenses 1 made by extrusion of hard and transparent material to the skins of eye sockets and let the ring faces 3*c* in the pads 3 of the swimming glasses contact tightly with the skins of eye sockets. Next, the head band 4 is pulled to a proper position of the back of the head. The swimming glasses can thus achieve airtight effect.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

I claim:

1. An improved pad structure of swimming glasses, comprising:

a pair of lenses, each of said lenses including (a) a first lock ring and a second lock ring, (b) a first edge ring face defining a perimeter of said lens, and (c) an annular pad joined to said first edge ring face, said annular pad including a front portion coupled to said first edge ring face, a second ring face having an annular contour and being spaced from said front portion by an annular groove, and a plurality of enhancement structures disposed in spaced relationship within said groove, each of said enhancement structures extending between said front portion and said second ring face for increasing a resistance to compression of said pad, said first lock ring projecting from a nasal side of said lens, said second lock ring formed on an opposing side of said lens and extending laterally from said lens;

a joining ring having a plurality of flanges for coupling to said first lock ring of said pair of lenses and adjusting a distance between said lenses;

a head band having opposed ends being inserted into respective ones of said second lock rings; and, a pair of locking members for securing said head band to said pair of second lock rings.

* * * * *